United States Patent [19]

Killilea

[11] Patent Number: 4,507,949

[45] Date of Patent: Apr. 2, 1985

[54] APPARATUS FOR COOLING A HOT-ROLLED PRODUCT

[75] Inventor: Daniel E. Killilea, Canton, Ohio

[73] Assignee: Republic Steel Corporation, Cleveland, Ohio

[21] Appl. No.: 348,079

[22] Filed: Feb. 12, 1982

[51] Int. Cl.[3] ..... B21B 45/02; B21B 43/00

[52] U.S. Cl. ..... 72/201; 134/122 R; 134/64 R; 266/113

[58] Field of Search ..... 62/64; 72/201; 134/15, 134/64 R, 122 R, 198, 199, 200; 148/153, 156; 266/111, 112, 113, 114

[56] References Cited

U.S. PATENT DOCUMENTS

| | | | |
|---|---|---|---|
| 1,682,823 | 9/1928 | Barord | 134/122 R |
| 1,998,192 | 4/1935 | Haswell | 134/122 R |
| 2,529,689 | 11/1950 | Hess | 266/113 X |
| 2,994,328 | 8/1961 | Lewis | 134/64 R X |
| 3,399,685 | 9/1968 | Jones et al. | 134/64 R |
| 3,646,790 | 3/1972 | Properzi | 72/201 X |
| 3,806,366 | 4/1974 | Cofer et al. | 72/201 X |
| 3,889,507 | 6/1975 | Kranenberg et al. | 72/201 |
| 3,897,230 | 7/1975 | Taylor et al. | 72/201 X |
| 4,084,798 | 4/1978 | Dewsnap et al. | 134/199 X |
| 4,136,544 | 1/1979 | Masahiko | 72/201 |
| 4,210,010 | 7/1980 | Vlad et al. | 72/201 |
| 4,308,881 | 1/1982 | Bertolotti et al. | 134/122 R |

*Primary Examiner*—E. Michael Combs

*Attorney, Agent, or Firm*—Watts, Hoffmann, Fisher & Heinke Co.

[57] ABSTRACT

An apparatus and method for cooling product in a continuous hot-rolling mill. The apparatus comprises a cooling unit including a frame defining a plurality of spaced, cartridge receiving slots in which a plurality of guide and spray cartridges are removably mounted. The guide and spray cartridges are similarly configured so that either cartridge can be mounted in a given frame slot so that the number and ratio of spray to guide cartridges can be varied to modify the cooling characteristics of the cooling unit. Headers, formed integrally with the cooling frame communicate with a source of coolant under pressure and include a plurality of outlets connectable to the spray cartridges by individual conduits. Valves are provided to adjust the coolant flow rate to a cartridge and a quick release coupling is utilized to enable the cartridges to be easily removed for service and/or replacement. One embodiment of a spray cartridge includes a housing that defines a central through passage in which radially directed nozzles are mounted, which are operative to spray coolant received from a coolant chamber defined by the cartridge housing, onto the product as it passes through the opening. In another embodiment, a spray tube defining a through passage is mounted in the cartridge housing and includes two sets of ports that communicate with the cartridge coolant chamber. One set of ports is angled with respect to the spray tube centerline whereas the other set of ports are directed radially. In the preferred cooling method, cooling units are placed before and after the last finishing roll stand so that pre- and post-roll cooling is provided.

15 Claims, 19 Drawing Figures

APPARATUS FOR COOLING A HOT-ROLLED PRODUCT

DESCRIPTION

1. Technical Field

The present invention relates generally to a continuous hot-rolling mill and in particular to a method and apparatus for cooling the product before and after the final rolling step.

2. Background Art

In a typical continuous hot rolling mill for producing steel wire, rod, bar stock or the like, a billet is normally heated to an elevated temperature, usually in the range of 2000° F. and then "passed" through a series of roll stands which squeeze the billet to produce overall elongation. The roll stands gradually reduce the cross-section of the billet until the final desired size and shape is obtained.

The roll stands are usually positioned along the processing line in three groups: the roughing train, the intermediate train, and the finishing train. When the product leaves the finishing train, it is generally cooled and, if its size permits, is then coiled.

As is well known in the art, a scale usually forms on the outer surface of a heated steel product as it is processed and cools. The scale typically consists of $FeO_2$ and other iron oxide complexes. The amount of scale that forms is somewhat a function of the rate of cooling. Thermal/mechanical shock and rapid cooling generally reduce the amount of scale on the finished product.

Minimizing the amount of scale formation is desired in the hot rolling process because the scale material constitutes a waste product of the process and reduces the yield from a given billet. Additionally, if the customer requires a scale-free product, the scale must be stripped in a separate process such as pickling, which adds to the manufacturing cost.

Apparatus and methods for controlling scale formation have been suggested by the prior art. One current method involves the rapid cooling of the product by direct spraying of a coolant liquid such as water. Generally the cooling is accomplished by a cooling device disposed in the product "pass line" after the final finishing roll stand. In theory, the direct impingement of water on the outer surface of the processed bar or rod should rapidly cool or quench the product to reduce its temperature a few hundred degrees. This temperature reduction helps inhibit scale formation.

The trend today in modern rolling mills is to improve the overall production rate by increasing the rolling speeds. Speeds in excess of 4000 ft.per minute and even 10,000 ft. per minute for smaller diameter stock, are not uncommon. In order to effect the rapid cooling, highly efficient cooling methods are necessary. Often space constraints within existing mills prevent the use of unreasonably long cooling devices and, therefore, in order to achieve needed cooling as rolling speeds increase, the cooling devices themselves must be made more efficient.

More efficient cooling devices have been suggested. However, in many of these suggested devices, efficiency was obtained with undue complexity rendering the devices very expensive and not easily serviced. It must be remembered that a hot-rolling mill generally presents a very harsh environment for the processing equipment. In addition, the apparatus must be able to handle the expected product misfeeds or "cobbles" without creating excessive down time in the processing line. In some of the more recent cooling apparatus, a cobble could result in rather expensive repair costs as well as unreasonable down time for the mill.

DISCLOSURE OF THE INVENTION

The present invention provides a new and improved cooling apparatus and method for use in a continuous hot-rolling mill that can effect rapid and efficient cooling of the product and which is easily serviced and maintained.

The cooling apparatus comprises an assembly positioned in the product "pass line" that is operative to spray coolant, such as water, around the entire periphery of the product as it travels through the assembly. According to the preferred embodiment, the assembly includes a frame that defines element receiving slots which are adapted to receive a plurality of removable spray and guide cartridge elements. The assembly also includes coolant supply headers that preferably form part of the frame structure and serve as a coolant source for the spray cartridges.

In the disclosed and preferred embodiment, the spray and guide cartridges are similarly sized so that either element can be inserted in a given frame slot. The number and ratio of guide and spray cartridges can be varied and is determined in part by the size of product traveling through the cooling assembly as well as the amount of cooling desired. For larger, more rigid bars and the like, less guide cartridges may be required and spray cartridges may be placed in the positions where guide cartridges would be placed for other bar sizes. In the illustrated embodiment the spray and guide cartridges are located in alternate positions preferably in an interleaved-like, juxtaposed arrangement.

According to a feature of the of the invention, the cooling rate for the cooling unit can also be adjusted by controlling the rate of coolant flow to the individual spray cartridges. In the preferred embodiment, each spray cartridge is individually communicated with an associated supply header by a conduit that preferably includes a quick release coupling as well as a flow control valve. This construction presents significant advantages over the prior art. The coolant flow to each spray cartridge can be separately controlled and even completely terminated if necessary. If a spray cartridge requires service, it does not render the entire cooling assembly inoperative. The cartridge requiring service is merely disconnected from the coolant supply (header) and replaced with an operative cartridge. Alternately, the defective cartridge can be left out of the cooling assembly if a replacement is unavailable.

In one preferred embodiment, the spray cartridge defines a coolant chamber and a substantially central product through-passage that surrounds the product "pass line." A plurality of spray nozzles are mounted in the passage and are directed radially towards the pass line. The nozzles communicate with and receive coolant from the coolant supply chamber defined by the cartridge. The coolant is sprayed onto the product as it passes through the opening in the cartridge. In this preferred embodiment, the nozzles of adjacent spray cartridges are offset 45° relative to each other. In this way, viewed from the pass line, the nozzles appear to be spaced at 45° intervals around the product passage defined by the cartridges.

In another preferred embodiment of the spray cartridge, the individual nozzles are replaced by an annular spray tube mounted centrally in the spray cartridge and surrounded by the coolant chamber. The spray tube includes a plurality of ports arranged in a circular pattern around the tube which direct coolant from the coolant chamber towards the product pass line. In the preferred configuration, two sets of ports are used. One set of ports is directed radially while the other set is directed at a predetermined angle with respect to the pass line. A range of port inclination angles between 15° and 60° has been found satisfactory.

The spray cartridge of the second embodiment is constructed so that it can be installed in the cooling box frame in two positions. In one position, the angled ports point towards the incoming product, or "against the product flow", whereas in the second position the cartridge is turned 180° and the angled nozzles direct coolant "with the product flow". This flexible configuration allows the cooling rate to be modified. The second set of ports directs the coolant spray radially regardless of the position in which the spray cartridge is installed.

Like the first spray cartridge embodiment, the second is also easily removed from the cooling unit and serviced. Provision has been made in the spray cartridge for relatively simple replacement of those parts expected to wear. For example, the spray tube is easily replaceable should clogging or wear of the ports occur.

The disclosed guide cartridge is similar in configuration to the spray cartridges. The slots defined by the frame can thus receive either a spray cartridge or a guide cartridge. The guide cartridge comprises a housing that removably mounts a tapered preferably curved guide element positioned substantially centrally within the housing. It has been found in an actual operation that the product normally travels on or near the bottom of the guide element. For this reason, the lower portions of the guide gradually wear. In the past, once a predetermined amount of wear occurred, the guide element had to be discarded and replaced. This problem is partially alleviated by the present invention. The cartridge is configured so that it can be removed, rotated a predetermined amount, preferably 90°, and then reinstalled in the frame, thereby exposing an unworn portion of the guide element. Additionally, once the cartridge has been rotated 360° (after four rotations of 90° in the preferred embodiment), the guide element itself can be rotated slightly, such as 45°, within the guide cartridge thereby making available four more unworn guide portions. With this improved construction, substantially greater life is obtained from a given guide element.

The present invention also includes a means for compensating for the difference between the theoretical pass line for the product and the actual path taken by the product as it travels through the cooling assembly. It has been found that the weight of the product will normally cause the product to follow a path substantially lower than the theoretical pass line. In some prior art constructions, the centerline of the guides and the spray elements are often coincident with the pass line. If the product actually travels below the pass line, the product receives a nonuniform coolant spray around the product periphery. In one embodiment of the present invention, the centerline of the spray cartridge opening is offset downwardly from the centerline of the guide element to compensate for the discrepancy between the actual product travel path and the theoretical pass line. With this embodiment, a uniform spray is applied to the product.

According to another feature, the cartridges positioned in the cooling assembly are spaced apart a sufficient distance to enable the coolant impinging on the product to drain unrestrictedly from the spray and guide cartridges. By preventing the coolant from collecting in either cartridge element, the heat transfer characteristics are improved. The coolant strikes the periphery of the product and is almost immediately drained from the vicinity of the cartridges.

Unlike many prior art constructions, the present apparatus can easily handle a "cobble". Sufficient spacing between the cartridges enables an operator to sever, if necessary, a product jammed in the cooling unit. Once appropriately severed, the product can be withdrawn from the end of the unit or alternately the cartridges can be lifted from the frame in order to facilitate removal. With this construction, very little down time is required to rectify the occurrence of a cobble.

According to the preferred method, product quality is improved by positioning a cooling assembly constructed in accordance with the invention before and after the first finishing roll stand. It is believed that pre- and post-finishing roll cooling produces a product having less scale than hot rolling processes that provide cooling only after the last finishing roll.

Due to the high cooling efficiency of the present invention, the cooling apparatus disclosed can be installed in present hot rolling mills without significant disruption of the mill operation. More importantly, the present invention provides a high cooling capacity in a small amount of space thereby enabling the unit to be retrofitted to existing mills.

Additional advantages of the invention will become apparent and a fuller understanding will be obtained in reading the following detailed description made in connection with the accompanying drawings.

BEST MODE FOR CARRYING OUT THE INVENTION

Figure 1:
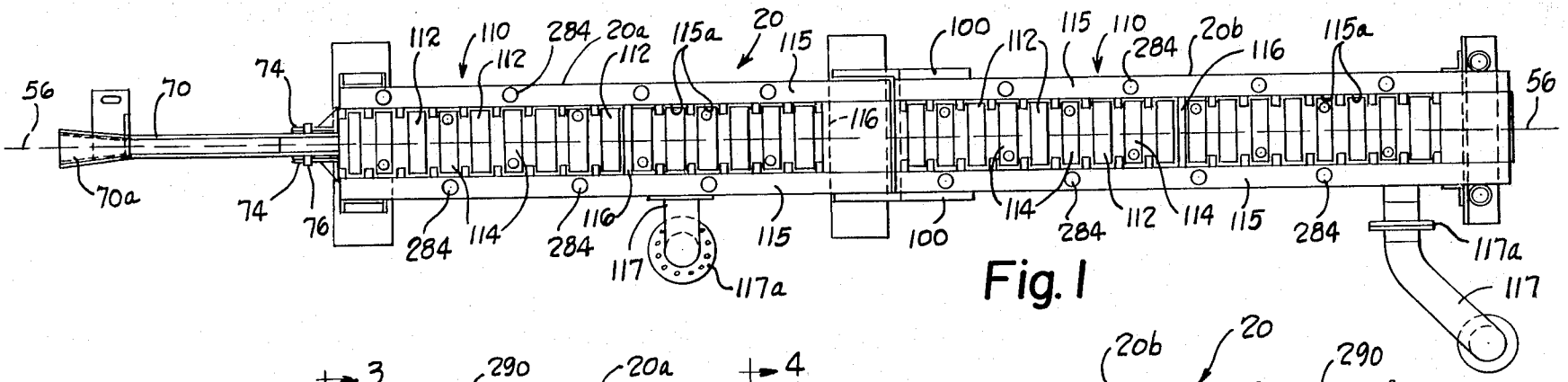
FIG. 1 is a plan view of a cooling apparatus constructed in accordance with the preferred embodiment of the invention, with certain parts omitted for clarity.
Figure 2:
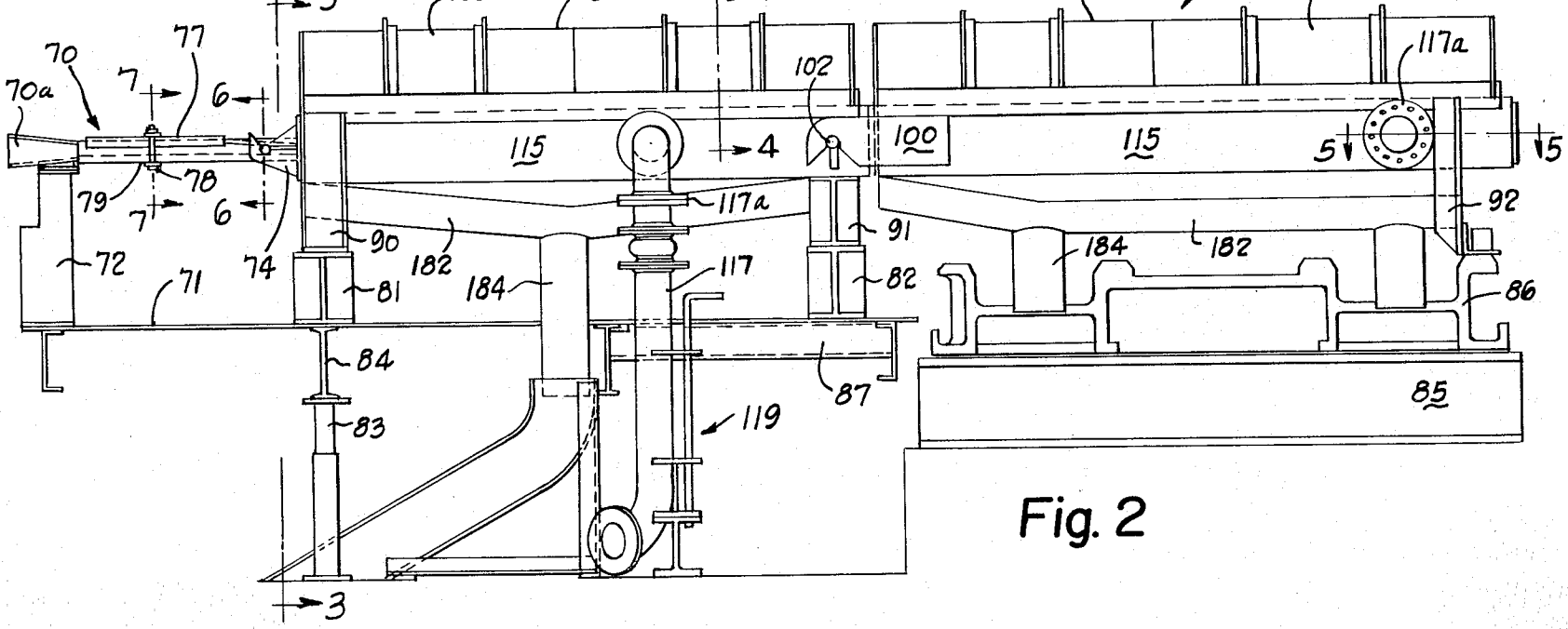
FIG. 2 is a side elevational view of the cooling apparatus.
Figure 19:
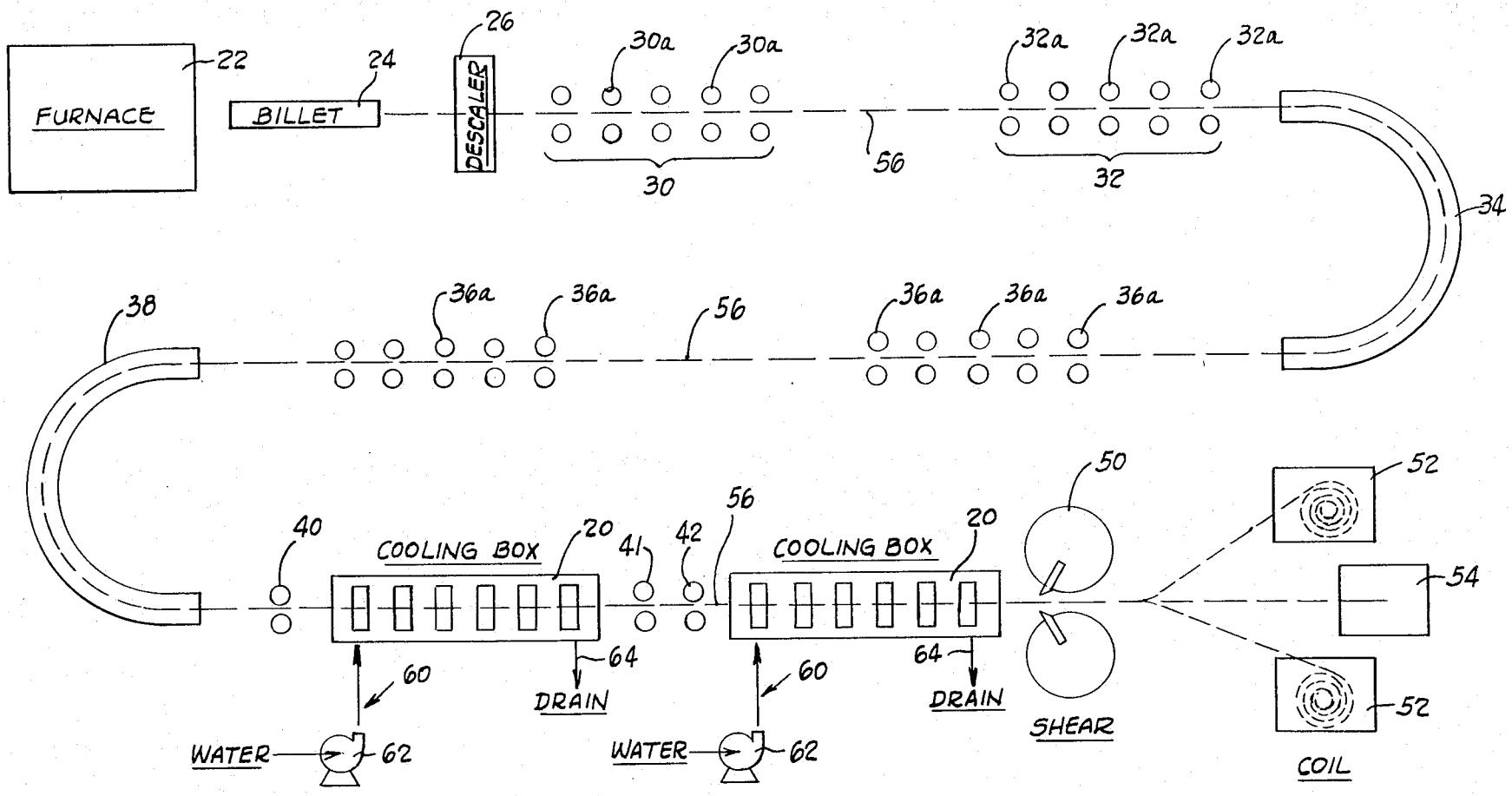
FIG. 19 is a schematic representation of an overall continuous hot rolling mill process embodying the present invention.

FIG. 19, somewhat schematically, illustrates the components used in a continuous hot-rolling mill including two cooling units 20 embodying the present invention. FIGS. 1 and 2 illustrate the overall construction of the cooling unit 20. For purposes of explanation, the unit 20 will be referred to as a "cooling box", but the word "box" should not be construed as a term of limitation for the present invention.

In general, a reheat furnace 22 heats a billet 24 to an elevated temperature, usually in the neighborhood of 2000° F. or higher. Those skilled in the art will recognize that the temperature to which the billet is heated is somewhat related to the process parameters and final end product desired. The heated billet is usually discharged by the furnace and passes through a descaler 26 which directs a water spray or compressed air on the periphery of the billet 24 to remove the scale formed during the reheat process. The descaler may be followed by a shear (not shown) for trimming the ends of the billet.

After leaving the descaler and/or shear, the billet 24 enters a roughing train 30 which comprises a series of roll stands 30*a*, each of which apply pressure to the billet to begin the reforming process. Generally, the rolls 30*a* apply compressive forces to the billet to reduce the billet cross section to produce overall elongation.

The product leaves the roughing train 30 and then enters an intermediate train 32, comprising a plurality of intermediate roll stands 32*a*. In older rolling mills, due to space limitations, the product is usually redirected 180° to another adjacently located section of the processing line by a curved guide 34 often termed a "repeater". The second section may include additional intermediate roll stands 36*a*. In the illustrated rolling mill, the product is again redirected 180° by another "repeater" 38 to a finishingg train which includes roll stands 40, 41, 42. The finishing train provides the last forming operation which produces the final desired product shape and size.

In the illustrated mill, the cooling boxes 20 are positioned before and after a final finishing station 43 formed by the roll stands 41, 42. After leaving the second cooling box (the rightmost box 20 in FIG. 19), the product may be cut to a desired length by a shear 50 and then either coiled, if desired, on coilers 52 or alternately, the product may be transported to another receiving location such as a cooling bed 54. The product travel path through the mill operation or "pass line" is designated by the dashed line 56.

As seen in FIG. 19, the cooling boxes 20 each communicate with a source of coolant 60 which in the preferred embodiment is water under pressure provided by a suitable pump 62. The coolant sprayed onto the product as it passes through the cooling boxes is discharged from each cooling box to a suitable drain 64 (indicated schematically). In most applications, the drain 64 communicates with a water treatment system (not shown). After treatment, the water is returned to the pump 62 for redelivery to the cooling boxes 20.

Figure 6:
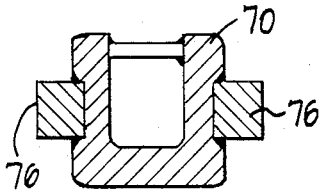
FIG. 6 is a sectional view as seen from the plane indicated by the line 6—6 in FIG. 2.
Figure 7:
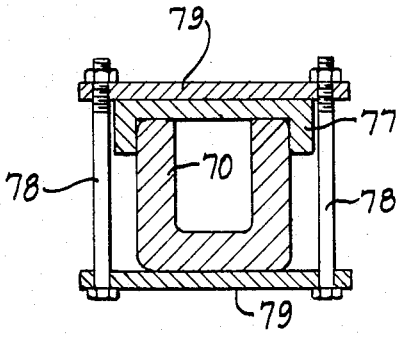
FIG. 7 is a sectional view as seen from the plane indicated by the line 7—7 in FIG. 2.

Returning now to FIGS. 1 and 2, the cooling box 20 comprises an elongate structure that is disposed in the product "pass line" 56. The product enters the cooling box through an entry guide 70 disposed on the left end of the cooling box 20 (as viewed in FIG. 1). The left end of the entry guide 70 defines a funnel-like mouth 70*a* and is supported above the mill floor 71 by a support 72. The right end of the guide 70 is pivotally connected to the end of the cooling box. A pair of hooks 74 extend laterally from the box 20 and engage lateral pins 76 (see FIG. 6) secured to the sides of the guide. As seen in FIGS. 6 and 7, the illustrated guide is substantially square in cross-section. Side-to-side clearance between the sides of the guide 70 and the hooks 74 is provided to enable lateral "pass line" adjustment between the guide 70 and the cooling box. Vertical "pass line" adjustment between the guide and cooling unit is achieved by pivoting the guide about the axis defined by the pins 76. To facilitate removal of cobbles, a substantial length of the guide 70 is enclosed by a removable top cover formed by a U-channel 77 (shown in FIGS. 2 and 7). The cover is secured to the guide 70 by bolts 78 extending and co-engaging clamping bars 79.

The cooling box 20 is supported above the mill floor 71 in alignment with the pass line by suitable support structure. FIG. 2 illustrates an example of support structure and includes transverse girders 81, 82, a support jack and an associated I-beam 83, 84 as well as other support girders 85–87, which together form a support bed for the cooling box 20. For flexibility in the mill operations, the cooling box 20 is constructed to be easily removable, if desired, so that other machinery, such as additional roll stands can be substituted for it. The cooling box 20 includes supports 90, 91 and 92 that rest atop or, are removably attached to, the girders 81, 82, 86. The attachment is commonly made with suitable fasteners such as wedge bolts (not shown) which allow the cooling units to be easily mounted or removed to facilitate changes in the processing line.

In the illustrated embodiment, the cooling box 20 comprises two attached portions 20*a*, 20*b*. The right portion 20*b* is pivotally attached to the left portion 20*a* by hooks 100 which extend laterally from the portion 20*b* and engage pins 102 that extend from the sides of the section 20*a*. The pivotal connection between the sections 20*a*, 20*b* allows some relative movement between the sections to facilitate pass line adjustment. Side clearance between the hooks provide lateral adjustment, whereas pivotal movement between the sections provides vertical adjustment. These sections may be used together as shown or separately if desired.

The sections 20*a*, 20*b* are identical in principle of operation. Each section 20*a*, 20*b* includes a support frame indicated generally by the reference character 110 that mounts a plurality of guide and coolant spray catridge elements 112, 114. In the disclosed embodiment, the cartridges 112, 114 are positioned side by side in a juxtaposed, interleaved-like relationship. The sides of the support frame 110 of each cooling section are preferably formed by a pair of longitudinally parallel tubular coolant supply headers 115. However, separate side supports are also contemplated.

As seen in FIGS. 1 and 2, flanges 117*a* facilitate the disconnection of the cooling sections 20*a*, 20*b* from the coolant supply pipes 117. A pipe restraint, indicated generally by the reference character 119, supports the pipe 117, but allows some movement to facilitate alignment of the pipe 117 with the flange 117*a*.

The water supply headers 115 of each section communicates with each other through tubular cross conduits 116*a*, 116*b* (shown best in FIGS. 4 and 9), which are positioned at the ends of the cooling box sections 20*a*, 20*b* above and below the pass line 56. The upper cross conduit, 116*a* is indicated in phantom in FIG. 1. With this construction, the coolant is delivered to one header of each section by a supply pipe 117 and is delivered to the adjacent header by way of the cross conduits 116*a*, 116*b*. A tie bar 116 preferably extends between the headers 115 of each section 20*a*, 20*b*, to prevent the headers from "bowing" outwardly and to add structural rigidity.

Figure 8:
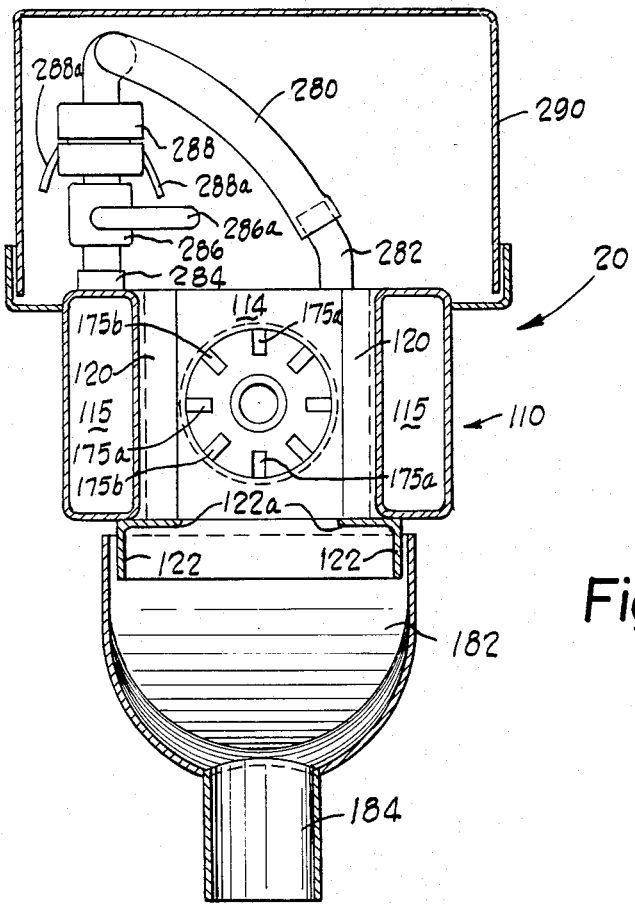
FIG. 8 is a sectional view of the cooling apparatus, partially in elevation, shown somewhat schematically, with parts omitted for clarity.

As seen best in FIG. 1, cartridge receiving slots 115*a* are defined between the headers 115. Referring also to FIG. 8, the cartridge receiving slots are defined in part by vertical spacer bars 120 suitably fastened to the inside surface of the headers 115 at spaced locations. A pair of angled members 122 (shown best in FIG. 8) are fastened to the bottom of the headers 115 and are oriented so a lateral leg 122*a* extends inwardly and below the bottom end of the spacer bars 120. The lateral leg 122*a* forms an abutment for the cartridge elements 112, 114. The cartridges 112, 114 are mounted in the cooling unit 20 by inserting them from the top of the unit and sliding them between the spacer bars 120 until the bottom of the cartridges contact and abut the lateral legs 122*a* of the angled members 122. It has been found that, under ordinary operating conditions, the weight of the elements maintains them in their operating position. A positive locking mechanism, however, is also contemplated by the invention.

Figure 12:
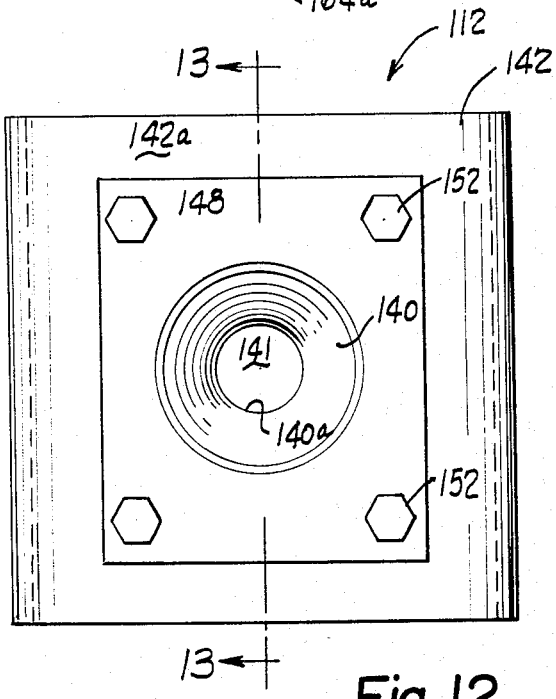
FIG. 12 is a side elevational view of a guide cartridge constructed in accordance with the preferred embodiment.
Figure 13:
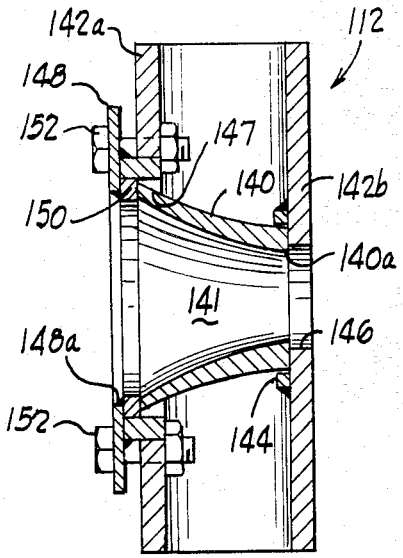
FIG. 13 is a sectional view of the guide cartridge as seen from the plane indicated by the line 13—13 in FIG. 12.

FIGS. 12 and 13 illustrate the construction of the guide cartridge 112. The cartridge 112 comprises a housing 142 and a tapered guide element 140 mounted substantially in the center of the housing 142. In the disclosed construction, the guide element 140 is preferably a unitary casting and defines a gradually narrowing curved through-passage 141. The housing includes opposed side walls 142*a*, 142*b*. A locating collar 144 is fastened to an inside surface of the side wall 142*b* and surrounds a central aperture 146. The guide 140 extends through a larger aperture 147 formed in the side wall 142*a* in coaxial alignment with the aperture 146. The narrow end of the guide 140, defining an exit opening 140*a*, is located by the collar 144. The wide end of the guide 140 is clamped in position by a mounting plate 148 that includes a central aperture 148*a* and a collar 150 that abuts the rim of the guide 140. The mounting plate 148 is clamped to the side wall 142*a* by a plurality of bolts 152. With this construction, the guide 140 can be easily replace when worn without necessitating complete replacement of the cartridge.

In the preferred embodiment, the cartridge 112 is polygonal, preferably square shaped, having four equal sides. With this configuration, the cartridge can be inserted in the cooling unit frame 110 in any of four positions. When a portion of the guide 140 exhibits undue wear, the cartridge is merely removed, rotated 90° and replaced in order to expose an unworn portion of the guide 140. Additionally, once the cartridge 112 has been rotated through the four positions, the guide 140 can be rotated slightly within the housing 142 (such as 45°) so that four more unworn guide portions can be utilized. Thus, with the present invention, the service life of the guide cartridge 112 is greatly extended.

Figure 10:
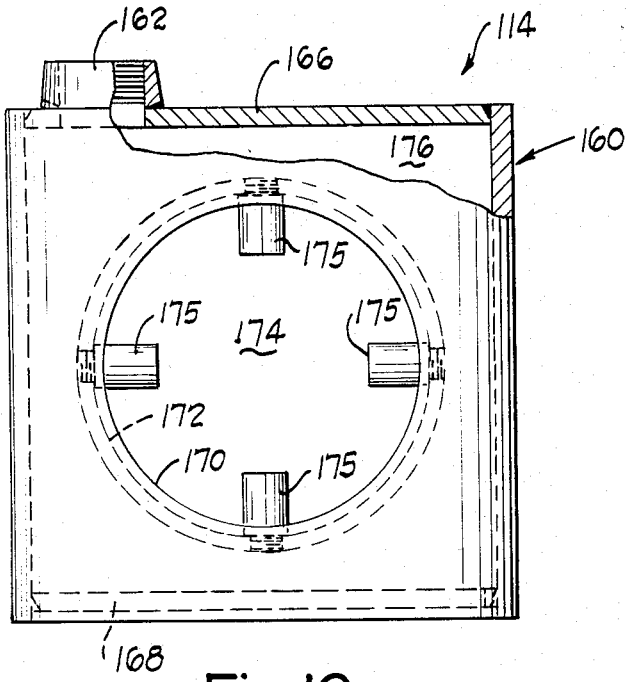
FIG. 10 is a side elevational view of a spray cartridge constructed in accordance with the preferred embodiment.
Figure 11:
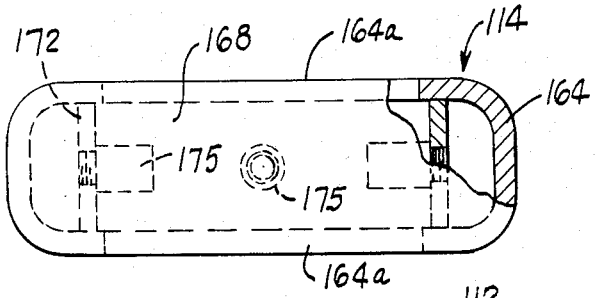
FIG. 11 is a plan view of the cartridge shown in FIG. 10, shown partially in section.

Turning now to FIGS. 10 and 11, one preferred embodiment of the spray cartridge 114 is illustrated. Preferably, the spray and guide cartridges 112, 114 are similarly shaped so that either can be mounted in a given slot 115*a* in the cooling box frame 110. The spray cartridge includes a sealed housing 160 having a coolant inlet 162. As best seen in FIG. 11, the housing 160 comprises a tubular channel section 164, the ends of which are sealed by top and bottom plate members 166, 168. Aligned apertures 170 are formed in side walls 164*a*. A ring 172 is fastened (as by welding) to the inside of a tubular section 164. The assembled spray cartridge defines a coolant chamber 176 and a central through passage 174. When the cartridge is installed in the cooling box frame 110, the product pass line 56 extends through the passage 174. A plurality of radially directed nozzles 175 are mounted to the internal ring member 172 and extend into fluid communication with the coolant chamber 176. In the illustrated cartridge the nozzles 175 are threaded into the ring 172 and are thus easily replaceable. The communication of coolant to the inlet 162 fills the coolant chamber with coolant which is then discharged through the nozzles 175. The coolant discharged by the nozzles is directed at the product as it passes through the cartridge 114.

The passage 174 and nozzles 175 are sized and selected so that the inner tips of the nozzles define an opening that is at least as large but preferably larger than the exit opening of the guide element 140 located in the adjacent guide cartridge. With this arrangement, the risk of product sticking the nozzles is minimized.

In order to provide a more uniform spray, certain of the cartridges 112 are fabricated with the nozzles 175 rotated 45° from the position shown in FIG. 10. In the preferred arrangement, the positions of the nozzles of adjacent spray cartridges are offset by 45°. As seen in FIG. 8, viewed from the pass line, the nozzles appear as though they are spaced at 45° intervals around the ring member 72. In FIG. 8, the nozzles indicated by the reference character 175*a* are mounted in one spray cartridge, whereas the nozzles designated by the reference character 175*b*, in fact, form part of an adjacent spray cartridge. Alternately, if space permits, all eight nozzles or any number of nozzles for that matter, may be mounted to the ring 172.

Figure 9:
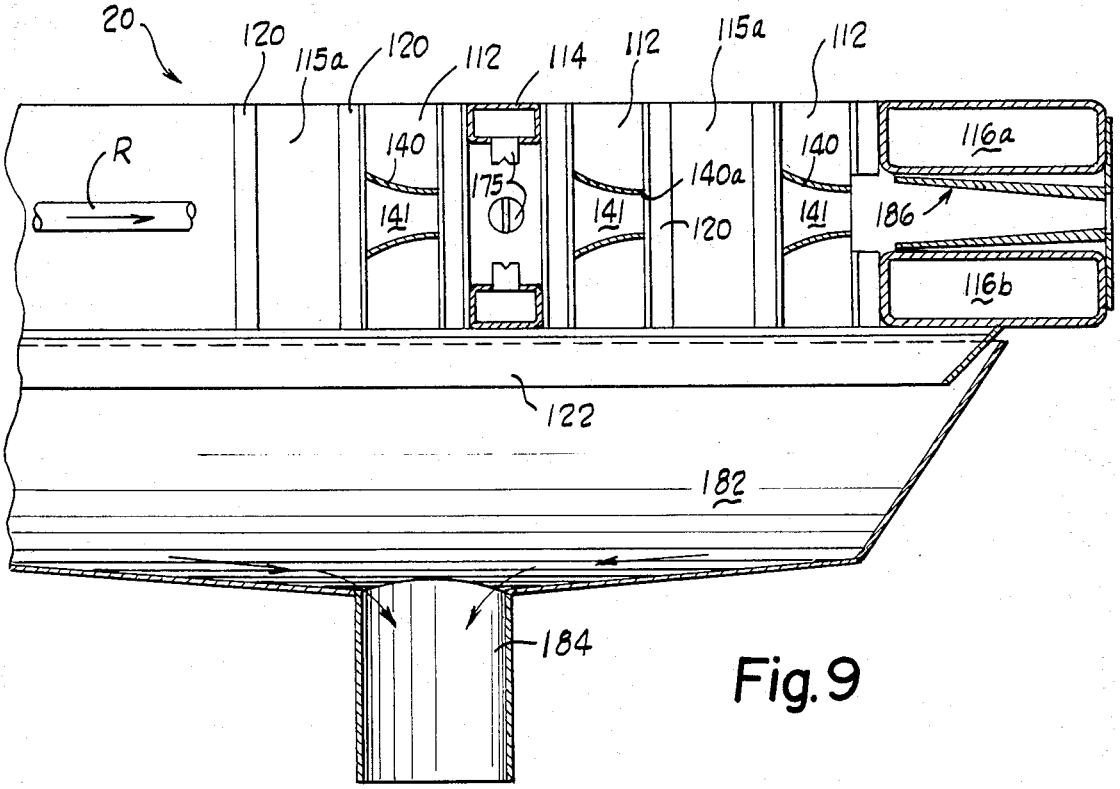
FIG. 9 is an enlarged, fragmentary sectional view of a portion of the cooling apparatus, shown somewhat schematically.

Turning now to FIG. 9, the operation of the cooling unit 20 is schematically illustrated. The product, in this case, a rod R enters the cooling box via the entry guide 70 (shown in FIG. 1). The guides 140 of the guide cartridges 112 support the rod R as it passes through each spray cartridge 114. Although one cartridge is shown in FIG. 9, it should be clear that a spray cartridge 114 would ordinarily be positioned in the slots 115*a* between the guide cartridges 112. As the rod passes through the spray cartridge 114, the coolant discharged by the nozzles 175 impinges on the outer surface of the rod and effects rather rapid cooling. The cooling rate is further facilitated by virtue of the spacing of the cartridges provided by the spacing bars 120. The spacing between the cartridges as well as the relatively short extent of the through passages defined by the cartridges 112, 114 allows the coolant to run off the rod R after impingement, without accumulating in either the spray cartridge or the guide cartridge. The coolant runoff is collected in a drain trough 182 that is mounted below the cooling unit and communicates with a drain conduit 184. The rod R leaves the cooling box via an exit guide indicated generally by the reference character 186.

Figure 5:
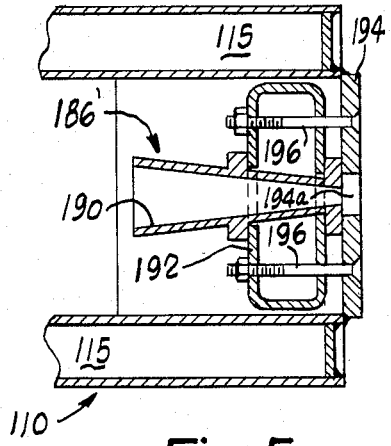
FIG. 5 is a sectional view of the apparatus as seen from the plane indicated by the line 5—5 in FIG. 2.

FIG. 5 illustrates a preferred exit guide 186' that includes a replaceable guide element 190. The guide element 190 is mounted to a support member 192 that is suitably clamped to an end plate 194 by a plurality of through bolts 196. The end plate 194 includes an aperture **194*a* aligned with a narrow end opening of the guide element 190. In the preferred construction, the diameter of the exit opening defined by the guide element 190 is less than the aperture 194*a* in the end plate 194. As a result the exit guide element 190 may be easily changed to accommodate a different sized product. In addition, the bulk of the wear at the exit of the cooling box caused by the product will be borne primarily by the guide element 190 which is relatively easy to replace and not by the end plate 194. The guide 190 like the guide element 140 (mounted in the cartridge 112**) is rotatable to position unworn portions in the actual product path.

Another preferred embodiment of a spray cartridge 114' is illustrated in FIGS. 3 and 14–16. In this embodiment, individual spray nozzles are eliminated. Instead, a tubular spray member having a plurality of spray ports is used to spray coolant onto the product as it passes through the cooling box. The spray cartridge 114' is defined by a square shaped housing 200 that comprises a tubular member 202 having its opened ends sealed by top and bottom plates 204, 206, respectively. A threaded inlet port 162' is suitably fastened to the top plate 204. A spray assembly support comprising a short length of square shaped box channel 212 extends through an aperture formed in a housing side wall **202*a* and is fastened to the inside surface of an opposite side wall 202*b*. Preferably, the element 212 is welded to the walls 202*a*, 202*b*. A coolant chamber 210 formed by the housing 200, surrounds the channel 212**.

Figure 3:
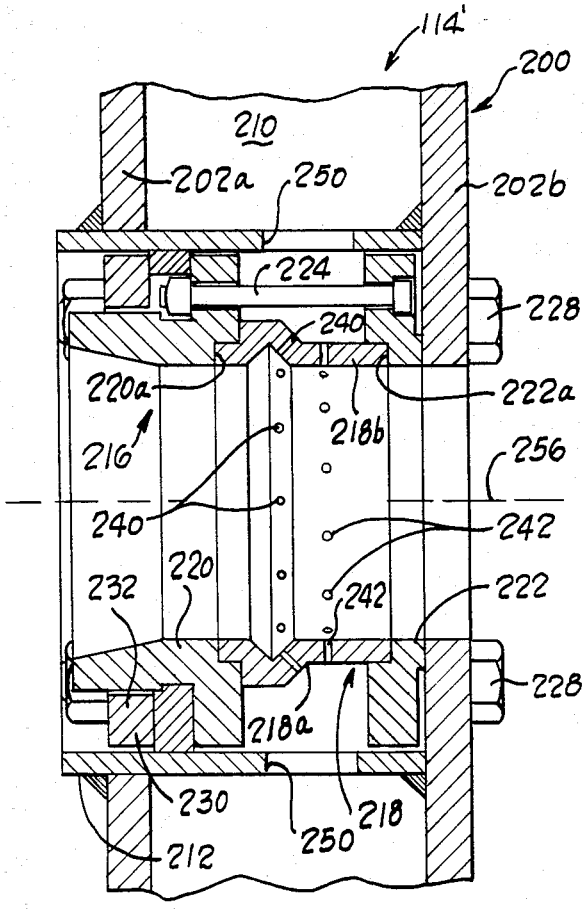
FIG. 3 is an enlarged sectional view as seen from the plane indicated by the line 3—3 in FIG. 15.

Referring in particular in particular to FIG. 3, a spray assembly 216 is removably mounted inside the channel 212. The spray assembly 216 includes a spray tube 218 clamped between mounting plates 220, 222 by a plurality of through bolts 224 (only one bolt is shown). The mounting plates 222, 224 are sized to fit inside the spray assembly support 212 and include annular step surfaces **220*a*, 222*a* which receive opposite ends of the spray tube 218. The assembly 216 is clamped to the inside surface of the wall 202*b* by a plurality of bolts 228 that extend from the side wall 202*b* and engage a clamping plate 230. A packing gland 232 is positioned between the clamping plate 230 and the spray assembly 216** to prevent fluid leakage past the spray assembly.

According to the invention, the spray tube 218 includes multiple sets but preferably two sets of spray ports 240, 242 arranged in two circular patterns around the periphery of the spray tube. In the illustrated embodiment, the spray tube includes an angled segment **218*a* in which the spray ports 240 are machined. The spray ports 242 are machined into a uniform segment 218*b* and are directed radially. The spray assembly suppot 212 includes slot shaped openings 250 (see FIG. 14) which communicates the coolant chamber 210 with the outer periphery of the spray tube 218. Thus, when fluid is communicated to the spray cartridge 114', the coolant, communicated through the slots 250, will be discharged through the angled and radial ports 240, 242** and impinge on the product passing through the spray cartridge.

Unlike some prior art cooling devices, the disclosed spray tube, directs "streams" of coolant towards the product pass line. In the preferred construction, the streams of coolant are focused at the centerline 252 (shown in FIG. 16) of the spray tube 218. The ports are configured to produce minimal dispersion of the streams and the sum of the diameters of at least one set of ports, but preferably both sets 240, 242 is approximately equal to the circumference or the perimetric dimension of the product being processed, within predetermined limits.

It is believed that extremely effective cooling can be achieved with the disclosed construction. The angled spray pattern provided by the ports 240, tends to strip moisture from the product so that only a thin film of coolant remains, enabling the coolant discharged by the second set of ports 242 to be equally effective. Residual moisture on the bar is thus minimized.

Like the other components of the disclosed cooling box, the spray cartridge 114' is also easily serviced. If the spray tube requires service or replacement, due to clogging, wear, etc., the cartridge is simply removed from the cooling box and disassembled by removing the assembly mounting bolts 228 and the spray tube clamping bolts 224. The spray tube 218 then is either repaired or replaced and the spray cartridge reassembled and reinserted into the cooling box 20.

Figure 16:
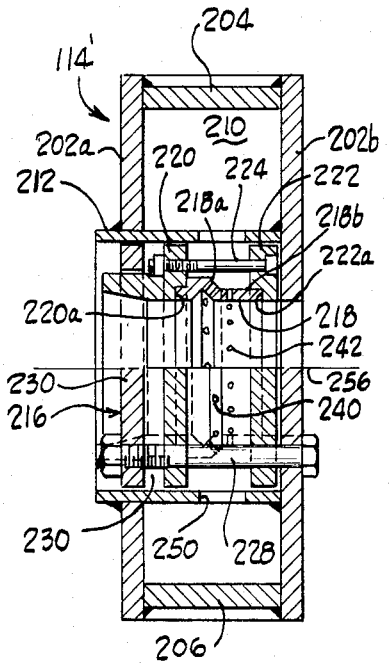
FIG. 16 is a sectional view of the spray cartridge as seen from the plane indicated by line 16—16 in FIG. 15.
Figure 17:
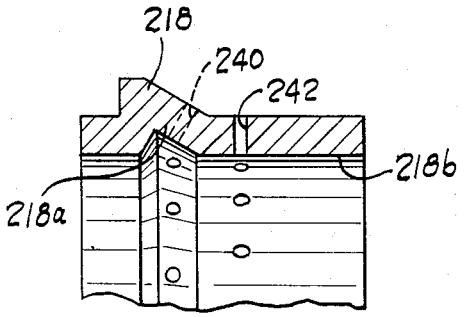
FIG. 17 is an enlarged, fragmentary sectional view of an alternate embodiment of a tubular spray element forming part of the spray cartridge illustrated in FIGS. 15–16.
Figure 18:
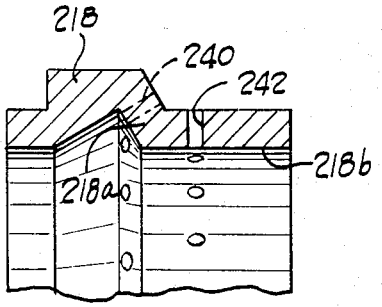
FIG. 18 is a fragmentary sectional view of still another embodiment of the tubular spray element.

FIGS. 17 and 18 illustrate alternate configurations for the spray tube 218. In the spray tube illustrated in FIG. 16, the axis of each angled port 240 defines an angle of substantially 45° with respect to the center line 254 of the spray tube 218. In FIGS. 17 and 18, the axes of the angled ports define angles of substantially 60° and 30°, respectively, with respect to the center line 254 of the spray tube. Either of the spray tubes illustrated in FIGS. 17 and 18 can be substituted for the spray tube shown in FIG. 16 to provide slightly different cooling characteristics.

The spray tube configuration should not be considered limited to the three illustrated constructions. Spray tube arrangements having any number of sets of ports and port angles are also contemplated. For example, the tube can be formed with a single set of radial or angled ports as well as multiple sets of radial and/or angled ports, or any combination therebetween.

The preferred and illustrated construction of the cartridge 114' enables it to be inserted into the cooling box in either of two positions. In one position, the angled ports 240 direct the spray towards the incoming product and thus the streams of coolant are sprayed "against the product flow". By rotating the cartridge 180°, the angled ports 240 are directed "with the product flow". In the second position, the product passing through the spray cartridge would first be struck by coolant sprayed from the radial ports 242 and then by coolant from the angled ports 240. In the first position, spray from the angled ports would impinge on the product first.

Returning now to FIGS. 1 and 8, coolant is communicated from the coolant supply headers 115 to each spray cartridge 114 by a conduit 280. Referring in particular to FIG. 8, the conduit 280 is suitably connected to an inlet nipple 282 that is attached to the spray cartridge inlet 162 (shown in FIG. 10). Each header 115 includes a plurality of spaced outlets 284 (shown in FIG. 1) which are adapted to receive a flow control valve 286 and quick release coupling 288. The valve 286 is utilized to adjust the flow rate to its associated spray cartridge 114. The quick release coupling 288 includes release handles **288*a* which are pivoted outwardly to release the upper half of the assembly in order to disconnect the conduit 280 from the header 115**.

Figure 4:
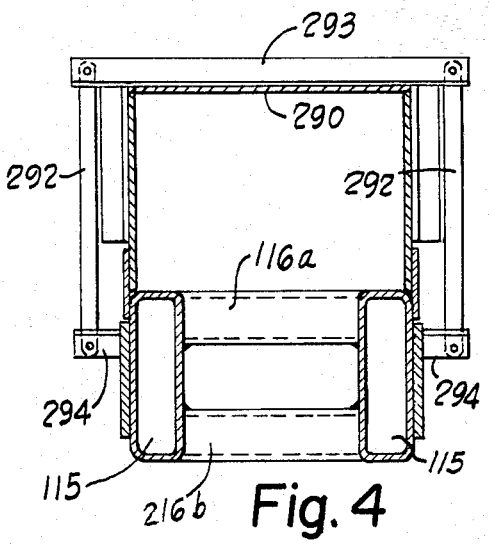
FIG. 4 is a sectional view of the apparatus as seen from the plane indicated by the line 4—4 in FIG. 2.

As seen in FIGS. 1, 4 and 8, the top of each cooling box section **20*a*, 20*b* is enclosed by a top cover 290, (the cover 290 is shown schematically in FIG. 8), to contain the coolant spray. Referring in particular to FIG. 4, the cover 290 is secured to its associated cooling box section by at least one pair of arms 292 that extend downwardly from a transverse angle member 293 and engage laterally extending anchors, fixed to the sides of the side frame members (headers) 115. With the disclosed construction, spray cartridges can be easily disconnected from the coolant supply and removed for service or replacement without requiring major disassembly of the cooling box 20**.

Figure 14:
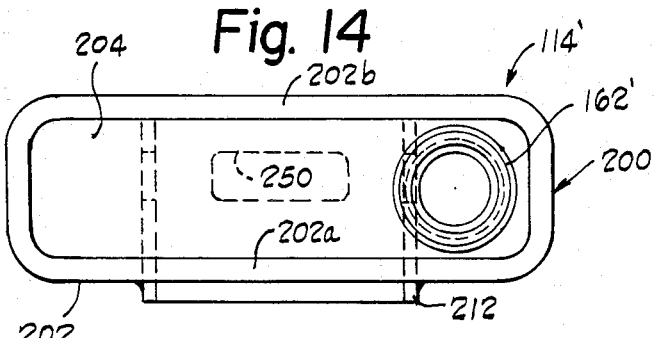
FIG. 14 is a plan view of another spray cartridge constructed in accordance with the preferred embodiment.
Figure 15:
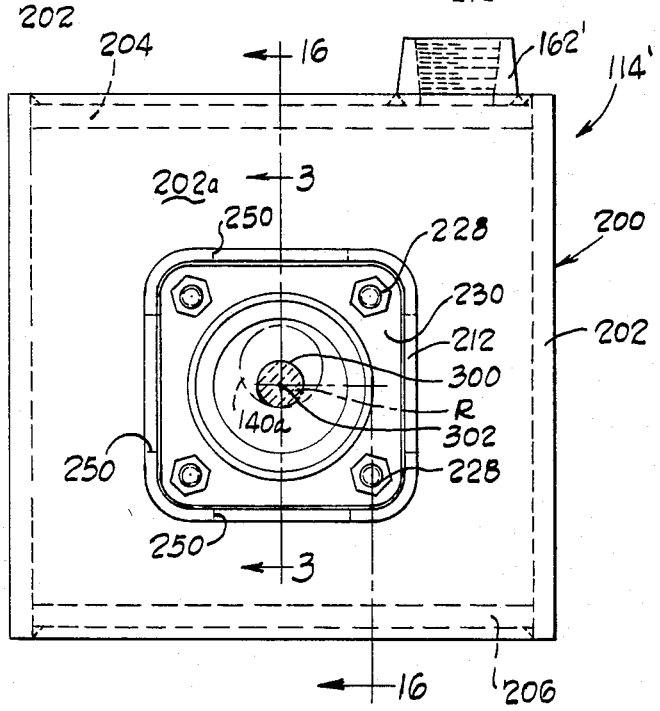
FIG. 15 is a side elevational view of the cartridge shown in FIG. 14.

According to the invention, the spray cartridge includes structural features that compensate for the difference in the theoretical product "pass line" and the actual travel path of product through the cooling box. It has been found that the product actually travels near the bottom of the guide elements 140 (mounted in the guide cartridges 112) and the exit guide 190, and not through the center of these guides. In order to provide a uniform spray, the centerline of the spray passage defined by the spray cartridge is displaced downwardly slightly. This downward displacement is illustrated in the second spray cartridge embodiment 114' as shown in FIGS. 14–16. It should be noted, however, that the spray cartridge 114 of the first embodiment can also be constructed similarly to provide the same compensation.

Referring in particular to FIG. 15, the outline of the exit opening **140*a* in a guide element 140 (which is detailed in FIG. 13) of an adjacent guide cartridge is indicated in phantom. The guide centerline is designated by the reference character 300. A rod R (also shown in phantom) travelling through the guide will generally travel along the bottom portion of the guide and its centerline, indicated by the reference character 302 will be displaced downwardly from the centerline 300 of the guide. In order to compensate for this displacement, the spray tube 218 is positioned in the spray cartridge housing so that its centerline 256 (indicated in FIG. 16) is substantially coincident with the centerline 302 of the rod R. With this configuration, the rod R travels substantially through the center of the spray tube 218** and receives a substantially uniform coolant spray around its periphery, thus uniformly cooling its outer surface.

The cooling box of the present invention can be used to cool product immediately following the last finishing roll stand. Ordinarily, it is desirable to rapidly reduce the product temperature by 200°–400° F. after final finishing and prior to coiling. Rapidly cooling or quenching the product substantially reduces scale formation.

Referring again to FIG. 19, a cooling method is illustrated which is believed to be more advantageous than a single cooling step following a final finishing roll stand. In the illustrated method, a cooling unit is disposed in the pass line 56 before and after the final roll station 43 (which includes, in this case, the roll stands 41, 42). The first cooling unit 20 (the left most unit as viewed in FIG. 19) begins the initial cooling of the product. Following this initial cooling, the product is finish rolled at the final roll station 43 and then enters the second cooling unit (the right most unit 20 as viewed in FIG. 19) which continues the cooling process begun in the first cooling box so that at total temperature reduction in the range of 200°–400° F. is obtained as the product travels through the cooling units 20 and the final roll station 43. It is believed that this pre- and post-roll cooling method produces a product of superior quality and characteristics than product that is cooled in a single cooling step following the final roll stand. The product produced by the arrangement shown in FIG. 19, among other advantageous characteristics will have less scale.

Although the invention has been described with a certain degree of particularity, it should be understood that various changes could be made to it by those skilled in the art without departing from the spirit and scope of the invention as hereinafter claimed.

The present invention has been found to provide an extremely efficient method and apparatus for cooling product such as wire, rod, bar stock, and the like, in a continuous hot rolling mill. The construction of the disclosed cooling box enables changes in its cooling rate and characteristics to be modified easily. The disclosed spray and guide cartridges are easily serviced and, as illustrated in the Figures, are sized, constructed, and spaced so that the coolant runoff is not retained in the vicinity of the product pass line and therefore highly efficient cooling is achieved. As has been fully disclosed, relatively short passages are defined by the cartridges and this combined with the spacing between adjacent cartridges, inhibits coolant accumulation in either cartridge. In the preferred embodiment, the downward displacement of the spray cartridge centerline relative to the guide cartridge centerline, compensates for the deviation of the product path from the theoretical pass line, thereby providing rather uniform cooling around the periphery of the product.

I claim:

1. A cooling box for cooling product in a continuous hot-roll mill, comprising:

(a) a source of coolant under pressure;

(b) structure defining a frame defining a plurality of spaced, cartridge receiving slots;

(c) a plurality of guide cartridges and spray cartridges removably disposed in the slots in said frame;

(d) each guide cartridge comprising a housing engageable by one of said slots supporting a repositionable tapered guide element for guiding product through said cooling box;

(e) each spray cartridge comprising a spray housing engageable by one of said slots defining a spray passage therethrough and further comprising spray means communicating with a coolant chamber defined by said spray housing and operative to spray coolant onto product passing through said spray passage; and (f) conduit means for communicating said source of coolant under pressure with said spray cartridge.

2. The cooling box of claim 1 wherein said conduit means includes at least one header forming part of said frame and a conduit extending between said header and said spray cartridge.

3. The apparatus of claim 2 further comprising a detachable connecting means between said conduit and said header and a valve means for controlling the coolant flow rate in said conduit.

4. The apparatus of claim 1 wherein said coolant comprises water under pressure.

5. The apparatus of claim 1 wherein a centerline for the spray cartridge is displaced downwardly relative to a centerline for said guide cartridge to compensate for deviations in the actual product path from a theoretical pass line.

6. The apparatus of claim 1 wherein said cartridges are spaced apart a sufficient distance to enable relatively uninhibited coolant drainage from the vicinity of said spray cartridge.

7. A water cooling assembly or a hot-rolling mill, comprising:

(a) a frame defining a plurality of similar, cartridge receiving slots;

(b) individual, replaceable guide and spray cartridges slidably mounted in said frame slots in a spaced, juxtaposed relationship, said cartridges defining a product pass line, and being similarly configured such that either a guide or a spray cartridge can be mounted in any one of said cartridge receiving slots in said frame; and (c) water supply means including detachable fluid conduit means for establishing fluid communication between a header and said spray cartridges.

8. The water cooling assembly of claim 7 wherein conduit means includes a flow regulating means for controlling the rate of water flow to said spray elements.

9. The cooling assembly of claim 7 wherein said conduit means includes individual conduits communicating said header with each spray element.

10. The cooling assembly of claim 7 wherein said guide cartridge comprises a housing removably mounting a tapered guide element defining a passage through said element.

11. The cooling assembly of claim 7 wherein said guide cartridge comprises a polygonal shaped cartridge that can be inserted in said element receiving positions of said frame in at least two different orientations.

12. The cooling assembly of claim 11 wherein said cartridge defines four equal sides thereby allowing said cartridge to be inserted in said frame in four different orientations.

13. The cooling assembly of claim 7 wherein said spray cartridge comprises a housing defining a coolant chamber and a passage through said cartridge, and further comprises spray nozzles extending into said passage operative to spray coolant from said coolant chamber onto a product passing through the cooling assembly.

14. The water cooling assembly of claim 7 wherein said water supply means includes a header forming an integral part of said frame.

15. A water cooling assembly for a hot-rolling mill, comprising:

(a) a frame defining a plurality of similar, cartridge receiving slots; and (b) a plurality of replaceable spray and guide cartridges slidably mounted in said frame in said receiving slots in a spaced, juxtaposed relationship, said spray and guide cartridges being similarly configured such that either a guide or a spray cartridge can be mounted into any one of said slots, said cartridges together defining a product pass line;

(c) said spray cartridges, each comprising:

(i) a housing defining a symmetrical, polygonal structure and further defining a coolant chamber surrounding a product through passage, disposed near the center of said housing;

(ii) said housing being engageable by a slot in said frame in any one of said several orientations;

(iii) spray means communicating with said coolant chamber and operative to provide a coolant spray directed towards a center line of said through passage; and, (iv) means for communicating said coolant chamber with a source of coolant;

(d) said guide cartridges, each comprising:

(i) a housing, mounting a tapered guide element defining a product through passage;

(ii) said housing defined by a symmetrical, polygonal shaped structure enabling said housing to be mounted in a plurality of orientations within a slot in said frame; and, (iii) said housing including a mounting means for said tapered guide element enabling said guide element to be mounted within the housing in one of several positions.

* * * * *